United States Patent [19]

Nakanishi

[11] Patent Number: 4,520,049

[45] Date of Patent: May 28, 1985

[54] METHOD AND APPARATUS FOR COATING

[75] Inventor: Takashi Nakanishi, Utsunomiya, Japan

[73] Assignee: Kao Corporation, Tokyo, Japan

[21] Appl. No.: 559,806

[22] Filed: Dec. 9, 1983

[30] Foreign Application Priority Data

Jan. 24, 1983 [JP] Japan ..... 58-9702
Mar. 24, 1983 [JP] Japan ..... 58-49415

[51] Int. Cl.[3] ..... B05C 3/02; B05D 3/12

[52] U.S. Cl. ..... 427/356; 118/323; 118/325; 118/410; 118/411; 118/413; 427/358; 427/359

[58] Field of Search ..... 118/325, 323, 300, 410, 118/411, 413; 427/358, 356, 359

[56] References Cited

U.S. PATENT DOCUMENTS 2,727,488 12/1955 Nerim ..... 118/411
3,106,481 10/1963 Sorg ..... 118/411
3,418,970 12/1968 Phelps et al. ..... 118/413
3,903,541 9/1975 Von Meister et al. ..... 118/410

*Primary Examiner*—Michael R. Lusignan
*Attorney, Agent, or Firm*—Birch, Stewart, Kolasch & Birch

[57] ABSTRACT

A coating method comprises the steps of feeding a base material into a gap defined between a coater die and a base material feeding roller and coating said base material with viscous material discharged from said coater die, wherein the dimension of the gap between the coater die and the base material feeding roller is adjustably varied under action of a pressure at which said viscous material is discharged from the coater die in response to a variation in said pressure. The coating apparatus used for execution of the coating method is so constructed that at least one of said coater die and base material feeding roller is supported by a displacement control device so that said coater die or said base material feeding roller is displaceable against action of said displacement control device under effect of a pressure at which viscous material is discharged from the coater die.

14 Claims, 11 Drawing Figures

METHOD AND APPARATUS FOR COATING

BACKGROUND OF THE INVENTION

The present invention relates to a method and apparatus for coating and, more particularly, to such method and apparatus for coating applicable, for example, to fabrication of so-called hot melt adhesive tape which is commonly used for various articles such as disposable diapers.

It is well known to produce hot melt adhesive tape or the like by a method in which a base material such as film is fed into a gap defined between a coater die which is stationary and mounted at a fixed position and a base material feeding roller comprising a rubber roller which is also stationary and mounted at a fixed position while said base material is coated with viscous material discharged from said coater die.

In such a method, however, various problems have been encountered such that said base material is often melted off at times when the base material is stopped or at times when the base material is fed at a relatively slow speed. Also, even during base material feeding at a relatively high speed, if the thickness of a viscous material increases, said base material coating is extended by an increased quantity of heat due to the increased coating thickness. The base material is readily subject to such melt-off and extension problems particularly when this base material is of a low softening point and coated with viscous meterial at a high temperature, so that these problems have prevented the above-mentioned known method from being widely adopted in practice for fabrication of hot melt adhesive tape or like.

SUMMARY OF THE INVENTION

A principal object of the present invention is to provide a method and apparatus for coating which is improved so as to eliminate the problems as mentioned above.

Such an object is achieved by a method for coating in accordance with the present invention comprising the steps of feeding a base material into a gap defined between a coater die and a base material feeding roller and coating said base material with viscous material discharged from said coater die, characterized in that a dimension of said gap defined between the coater die and the base material feeding roller is adjustably varied under action of a pressure at which said viscous material is discharged from the coater die in response to variation in said pressure.

The object of the invention is achieved also by an apparatus for coating constructed according to the present invention used for execution of said method comprising the coater die and the base material feeding roller located adjacent said coater die, characterized in that at least one of the coater die and base material feeding roller is supported by a displacement control device and that said coater die or said base material feeding roller is adjustably displaced under action of a pressure at which said viscous material is discharged from said coater die against action of said displacement control device.

According to the present invention, a dimension of the gap defined between the coater die and the base material feeding roller is adjustable depending on the variation in the pressure at which the viscous material such as a hot melt thermal adhesive is discharged from the coater die onto the base material. This provides a desired cushioning effect between the coater die and the base material feeding roller during coating of viscous material, permits the pressure at which a mass of viscous material should be discharged from the coater die to be optimally adjusted depending on a viscosity of said viscous material and facilitates the regulation of the coating thickness in the order of microns.

Furthermore, it is possible, according to the present invention, to use a base material feeding metallic roller which is capable of obtaining smoothness, core circularity less than 1 micron and a high thermal conductivity in the place of a conventional rubber roller so that, when such metallic roller is used at a low temperature or at other suitable conditions, a coating of high precision and evenness can be achieved and the previously mentioned melt-off and extension of the base material, such as a film, can be effectively avoided. As a result, it is possible according to the present invention to coat thin or low softening point films with a hot melt adhesive at a high temperature and a high viscosity, which has usually been considered difficult to achieve.

BREIF DESCRIPTION OF THE DRAWINGS

DESCRIPTION OF THE PREFERRED EMBODIMENTS

Figure 1:
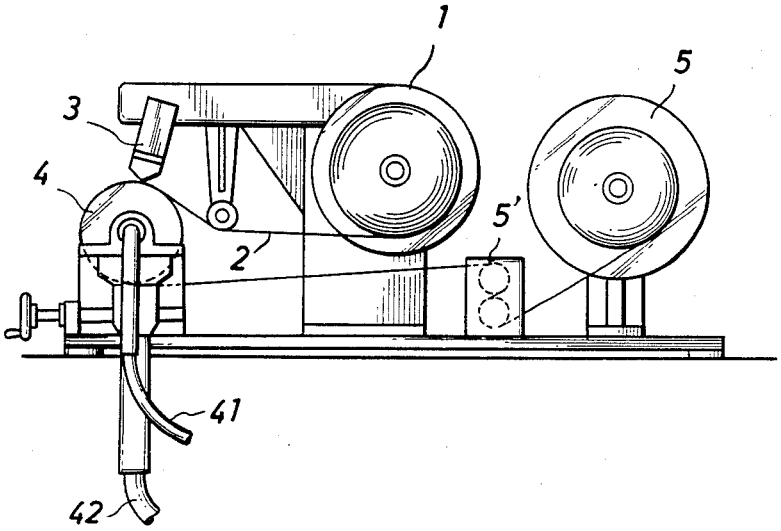
FIG. 1 is a side elevational view of an apparatus as a preferred embodiment of the present invention.

Initially, the preferred embodiments of the apparatus according to the present invention suitable for use to execute the method according to the present invention will be described with reference to the accompanying drawings. Referring to FIG. 1 schematically illustrating a preferred embodiment of the coating apparatus constructed according to the present invention, reference numeral 1 designates a base material delivery roller. Base material 2 such as film delivered from the base material delivery roller 1 is fed between a coater die 3 and a base material feeding roller 4 to be coated with viscous material discharged from a discharge nozzle opening at an end of the coater die 3, then through drive rollers 5' and finally taken around a take-up roller 5.

Figure 2:
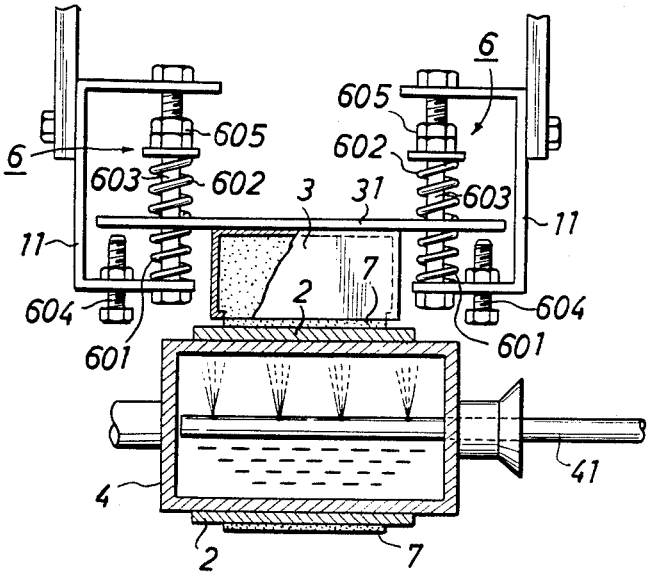
FIGS. 2 and 3 are a front section and a side section, respectively, of an important part of FIG. 1.
Figure 3:
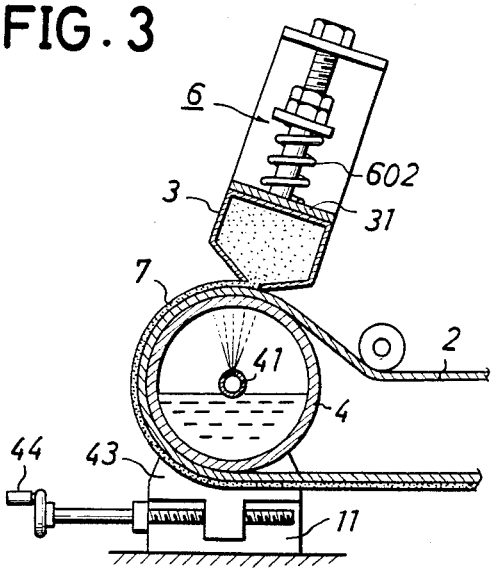

In the coating apparatus according to the present invention, as best seen in FIGS. 2 and 3, the coater die 3 is suspended by a displacement control device 6 comprising springs 601, 601, 602, 602 on a main frame 11 of the apparatus. The coater die 3 is fixed to a movable plate 31, so that the latter and, therefore, the coater die 3 also are displaceably supported by a pair of guide shafts 603, 603 fixed to the main frame 11 of the apparatus substantially in a vertical direction under a biasing effect from the below mounted springs 601, 601 mounted around the respective guide shafts 603, 603 and a biasing effect from the above mounted second springs 602, 602 similarly mounted around the respective guide shafts 603, 603. Displacement of the movable plate 31 downwards, i.e., towards the base material feeding roller 4, is adapted to be regulated by adjusting bolts 604, 604 threaded from underneath into the respective main frames 11, 11 against the underneath side of movable plate 31. The biasing effect of the second springs 602, 602 acting upon the movable plate 31 from under is adapted to be adjusted by adjusting nuts 605, 605 threaded on the respective guide shafts 603, 603 to level-regulate the respective upper ends of the second springs 602, 602. These adjusting bolts 604, 604 and adjusting nuts 605, 605 serve to adjust a balance between the biasing effect of the first springs 601, 601 and the second springs 602, 602, on one side, and the load of the coater die 3 and movable plate 31, on the other side, and thereby to adjust a coating pressure (loading pressure) of the coater die 3 exerted towards the base material feeding roller 4 during the coating operation. For example, the adjusting bolts 604, 604 may be adjusted to respective positions at which the biasing effect of the first springs 601, 601 is in equilibrium with the load of the coater die 3 and the movable plate 31 in a state wherein the adjusting bolts 604, 604 have been moved downwards until the biasing effect of the second springs 602, 602 attains 0 $kg/cm^2$ to adjust said coating pressure to 0 $kg/cm^2$. The adjusting bolts 604, 604 may be adjustably moved upwards and the adjusting nuts 605, 605 also may be adjustably moved downwards from the state as mentioned just above to increase said coating pressure, since the movable plate 31 is thereby biased downwards but further movement thereof is effectively regulated by the adjusting bolts 604, 604.

The base material roller 4 comprises a metallic hollow roller within which a cooling medium can flow. Referring to FIG. 1, reference numeral 41 designates a cooling medium inlet pipe and reference numeral 42 designates a cooling outlet pipe. The base material feeding roller 4 is rotatably mounted on a movable support 43 which is, in turn, forwardly and backwardly slidably mounted on the main frame 11 so that a position of the movable support 43 may be adjusted by operation of a handle 44 and thereby permit adjustment of the gap and/or alignment between the coater die 3 suspended substantially in vertical direction, as shown in FIG. 3, and the base material feeding roller 4. Certainly the base material feeding roller 4 may be a rubber roller of a low heat conductivity so far as this can be cooled by suitable cooling medium at a low temperature, but with such rubber roller it is difficult to obtain smoothness and core circularity of less than 1 micron and, therefore, to realize coating of high precision and evenness. Accordingly, it is preferred to employ the metallic roller permitting such difficulty to be reliably avoided. Use of the metallic roller as the base material feeding roller 4 facilitates manufacturing of the roller itself and enables the material 2 to be effectively cooled even when a cooling medium at a relatively high temperature is used, since such a metallic roller has a high thermal conductivity.

Now the manner in which the method acccording to the present invention is executed by using the preferred embodiments of the apparatus according to the present invention will be described. Prior to coating of the base material 2 being fed between the coater die 3 and the base material feeding roller 4 with viscous material 7, the coating pressure of the coater die 3 directed to the base material feeding roller 4 is adjusted by operating both the adjusting bolts 604, 604 and the adjusting nuts 605, 605 which function, in turn, to adjust the associated springs 601, 601, 602, 602, as previously mentioned, so as to meet a requirement for a desired manner of coating. Additionally, after the base material 2 is fed between the coater die 3 and the base material feeding roller 4, the base material feeding roller 4 is slidably moved in a forward or backward direction by operating the handle 44, also as already described, thereby optimally adjusting the gap between the coater die 3 and the base material feeding roller 4 to satisfy the requirement for said manner of coating. Thereafter, viscous material 7 is discharged, from the discharge nozzle opening at the forward end of the coater die 3, onto the base material 2 fed between the coater die 3 and the base material feeding roller 4. The coater die 3 floats against the coating pressure thus adjusted by the springs 601, 601, 602, 602 and vertically displaces in response to a variation in the discharge pressure of viscous material 7 from the coater die 3 to assure that the base material 2 is evenly coated with viscous material 7 at a predetermined discharge pressure. At the same time, the base material 2 is effectively cooled by the base material feeding roller 4 from under so that, when hot melt adhesive is used as viscous material 7 and film is used as base material 2, for example, melt-off and a extension of said base material due to a thermal factor is effectively avoided. It should be noted here that, during the coating operation as mentioned above, the discharge pressure of viscous material 7 from the coater die 3 strives to expand the first springs 601, 601 and to compress the second springs 602, 602.

Figure 4:
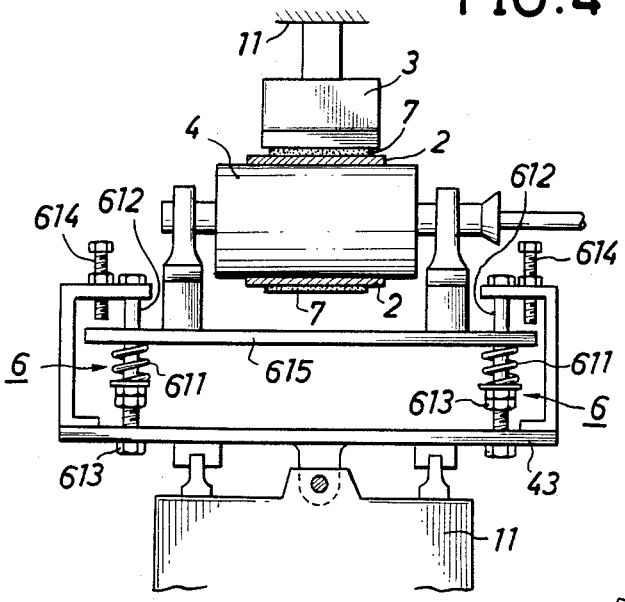
FIGS. 4 and 5 are a front view and a side section, respectively, of an important part of an apparatus as another embodiment of the present invention.
Figure 5:
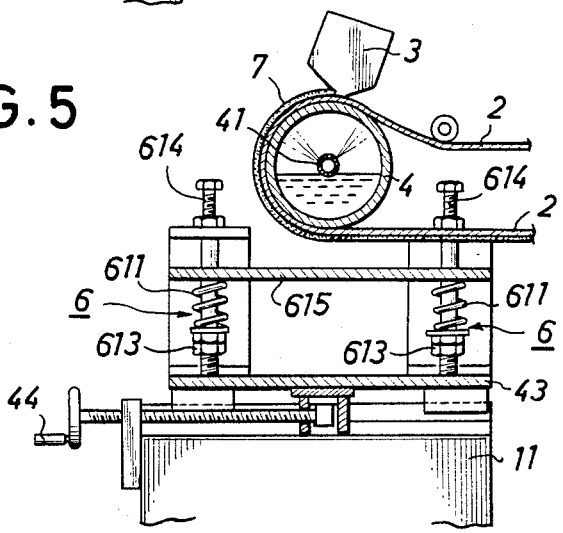

FIGS. 4 and 5 illustrate another embodiment of the coating apparatus constructed according to the present invention. In this embodiment, contrary to the embodiment of FIGS. 1 through 3, the coater die 3 is fixed to the main frame 11 while the base material feeding roller 4 is supported by the displacement control device 6 consisting of springs 611, 611 on said movable support 43. The base material feeding roller 4 is rotatably mounted on movable plate 615 which is vertically displaceable along guide shafts 612, 612 and the movable plate 615 is supported by the springs 611, 611. However, this embodiment is similar to the previous embodiment in that the coating pressure with respect to the base material 2 is adapted to be adjusted under adjustment of the springs 611, 611 by operating respective adjusting nuts 613, 613 and respective adjusting bolts 614, 614 and that a gap dimension between the coater die 3 and the base material feeding roller 4 is adjustably displaceable under a pressure at which viscous material 7 is discharged from the coater die 3, i.e., under a force striving to compress said springs 611, 611. Accordingly, the coating method according to the present invention can be executed by using this embodiment as effectively as by using the previous embodiment of the coating apparatus constructed according to the present invention.

Figure 6:
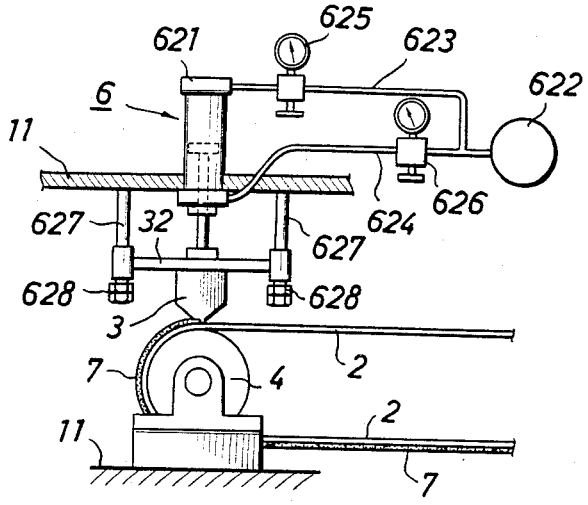
FIGS. 6 and 7 are a side elevational view and a front view, respectively, of an important part of an apparatus as still another embodiment of the present invention.
Figure 7:
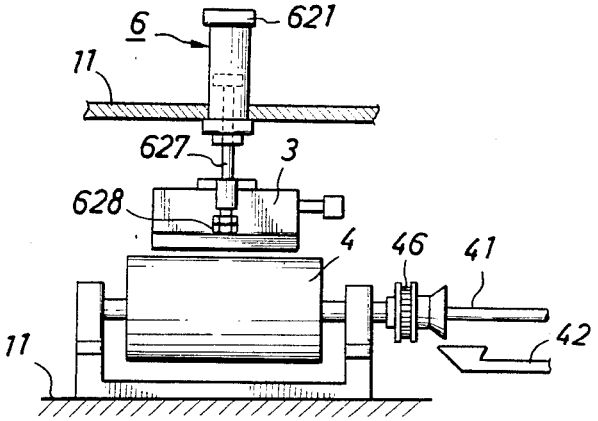

FIGS. 6 and 7 illustrate still another embodiment of the coating apparatus constructed according to the present invention. In this embodiment, the base material feeding roller 4 is mounted on the main frame 11 of the apparatus while the coater die 3 is mounted on the lower end of the displacement control device 6 which is, in turn, fixed to the main frame 11 so that said coater die 3 is positioned above said base material feeding roller 4. In this case, the displacement control device 6 consists of an air cylinder 621. Adjustment of the coating pressure by the displacement control device 6 may be achieved by regulating air pressure introduced from an air pump 622 through a pipe 623 into an upper chamber of the air cylinder 621 and regulating an air pressure introduced from the air pump 622 through a pipe 624 into a lower chamber of the air cylinder 621. This regulation is achieved by regulators 625, 626, respectively, resulting in a differential air pressure between the upper chamber and the lower chamber which is adjusted, for example, so that a load of the coater die 3 may be balanced. Reference numeral 627, 627 designates slide shafts for slidably guiding forward ends of arms 32, 32 laterally projecting from the upper end of the coater die 3 on both sides. Displacement of the coater die 3 is limited to a vertical direction by said slide shafts 32, 32. Gap adjusting nuts 628, 628 threaded into outer ends of the associated slide shafts 32, 32 serve to regulate downward displacement of said slide shafts 32, 32 so as to adjust the minimum gap dimension between the coater die 3 and the base material feeding roller 4. Reference numeral 46 designates a drive pulley for the base material feeding roller 4.

Now it will be described how the coating method according to the present invention is executed by using this embodiment of the apparatus constructed in accordance with the present invention. Prior to coating of base material 2 with viscous material 7, the coating pressure is adjusted by the displacement control device 6 so as to satisfy a requirement for a desired manner of coating. After the base material 2 is fed between the coater die 3 and the base material feeding roller 4, a gap dimension between them is adjusted by operating the gap dimension adjusting nuts 628, 628 to the minimum value. Then, viscous material 7 is discharged from the discharge nozzle opening at the forward end of the coater die 3 on the base material 2 which was fed between the coater die 3 and the base material feeding roller 4. In response to this discharge, the coater die 3 floats against the coating pressure determined by the displacement control device 6 and becomes vertically displaceable to compensate for variation in the discharge pressure of viscous material 7 from the coater die 3 so that the base material 2 may be evenly coated with viscous material 7 at a predetermined discharge pressure.

Figure 8:
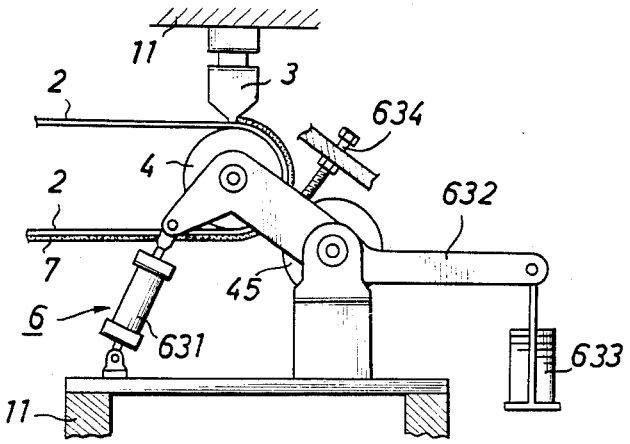
FIGS. 8 and 9 are a side elevational view and a front view, respectively, of an important part of an apparatus as further another embodiment of the present invention.
Figure 9:
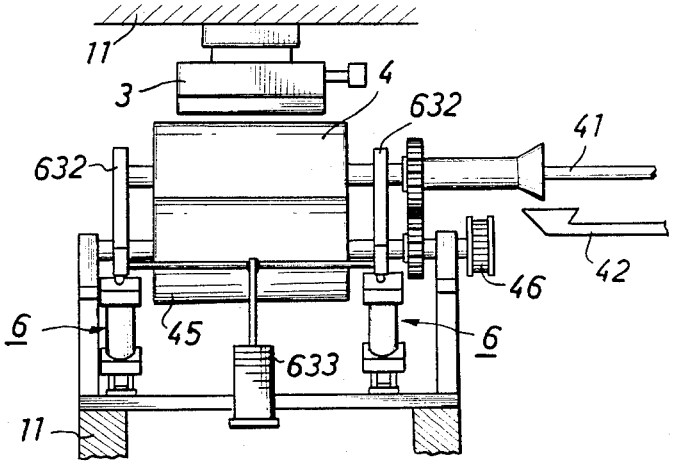

FIGS. 8 and 9 illustrate yet another embodiment of the coating apparatus according to the present invention. In this embodiment, contrary to the embodiment as illustrated by FIGS. 6 and 7, the coater die 3 is fixed to the main frame 11 of the apparatus while the base material feeding roller 4 is suspended by the displacement control device 6. As the displacement control device 6, an air cylinder 631 is utilized in this case as in the embodiment of FIGS. 6 and 7. Furthermore, the base material feeding roller 4 is mounted on one end of a swinging arm 632 adapted to swing around the bearing portion of the drive roller 45 serving to drive the base material feeding roller 4 through a gear and said one end is linked by the displacement control device 6 to the main frame 11 of the apparatus. The swinging arm 632 carries at the other end a counter weight 633 with respect to a weight of the base material feeding roller 4. Reference numeral 634 designates a gap adjusting bolt having the same function as the gap adjusting nuts in the previously mentioned embodiments. When base material 2 is coated with viscous material 7 by using this embodiment of the coating apparatus, it is possible to displace the base material feeding roller 4 against the action of the displacement control device 6 under the discharge pressure of viscous material 7 from the coater die 3 and, as a result, base material 2 can be evenly coated with viscous material 7 at a predetermined pressure independently of a variation in the discharge pressure of viscous material 7 from the coater die 3.

Figure 10:
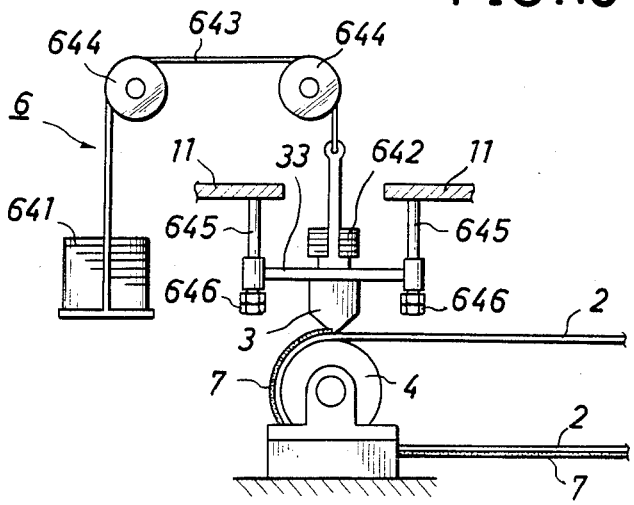
FIGS. 10 and 11 are a side elevational view and a front view, respectively, of an important part of an apparatus as still further another embodiment of the present invention.
Figure 11:
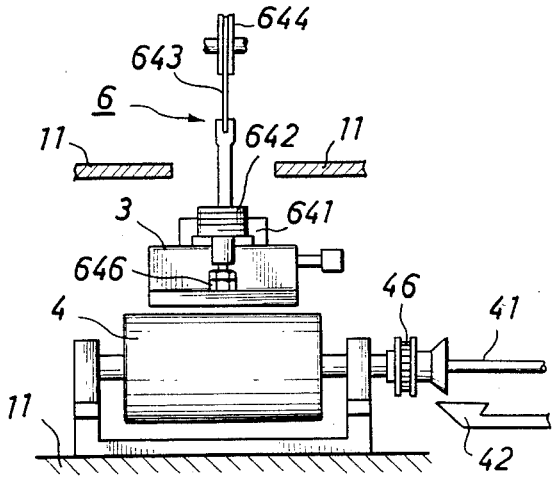

FIGS. 10 and 11 illustrate a still further embodiment of the apparatus according to the present invention in which a pair of weights 641, 642 are utilized as the displacement control device 6. In this embodiment, a length of rope 643 having the coater die 3 fixed to one end and the weight 641 fixed to the other end in order to balance a load of said coater die 3 is suspended over pulleys 644, 644 so that the coating pressure may be adjusted by placing a selected weight 642 on the coater die 3. Therefore, also with this embodiment, it is possible to coat base material 2 evenly with viscous material 7 at a predetermined pressure, since the coater die 3 is vertically displaceable against the load of the weight 642 to compensate for a variation in the discharge pressure of viscous material 7. It should be understood that, instead of using the weight 642, only the weight 643 may be utilized to adjust the coating pressure. Reference numeral 645, 645 designates slide shafts serving for a vertical guide of the coater die 3. Gap adjusting nuts 646, 646 are threaded into the slide shafts 645, 645 at the respective outer ends and function to regulate downward displacement of arms 33, 33 laterally extending from the coater die 3 into opposite directions so as to adjust the minimum gap dimensions between the coater die 3 and the base material feeding roller 4.

It is also possible within the scope of the invention to employ, as the displacement control device 6, the other means such as magnetic repelling mechanism, a motor cylinder and a friction plate. Moreover, although base material 2 and viscous material 7 used in the present invention is principally subject to no specific restriction, the present invention is particularly suitable for coating of film with hot melt adhesive to produce so-called hot melt adhesive tape.

What is claimed is:

1. A coating method comprising feeding base material into a gap defined between a coater die and a base material feeding roller and coating said base material with viscous material discharged from said coater die, the dimension of said gap between the coater die and the base material feeding roller being adjustably varied under action of a pressure at which said viscous material is discharged from the coater die in response to a variation in said pressure, wherein said coater die is located above and adjacent said base material feeding roller, is displaceable in a substantially vertical direction and is supported by a displacement control device, said displacement control device including a first upward adjustable biasing means for upwardly biasing said coater die away from said base material feeding roller and a second downward adjustable biasing means for downwardly biasing said coater die toward said base material feeding roller, whereby said coater die is vertically displaceable against the action of said displacement control device in accordance with the pressure at which viscous material is discharged from said coater die.

2. A coating method according to claim 1, wherein said first upward adjustable biasing means and said second downward adjustable biasing means comprise a first spring means and a second spring means, respectively, which serve to support the coater die.

3. A coating method according to claim 2, wherein said discharge pressure of viscous material from the coater die strives to expand said first spring means and to compress said second spring means.

4. A coating method according to claim 1, wherein said displacement control device comprises an air cylinder having upper and lower chambers, said lower chamber providing a first upward adjustable biasing means and said upper chamber providing a second downward adjustable biasing means.

5. A coating method according to claim 1, wherein said first downward adjustable biasing means includes a weight serving to bias the coater die towards the base material feeding roller and said second upward adjustable biasing means includes a counter weight serving to bias the coater die away from the base material feeding roller.

6. A coating method according to claim 1, wherein a cooling medium flows through the interior of the base material feeding roller during the coating process.

7. A coating method according to claim 6, wherein the base material feeding roller comprises a metallic roller.

8. A coating apparatus comprising:

a coater die;

a base material feeding roller located below and adjacent said coater die;

said coater die being displaceable in a substantially vertical direction and being supported by a displacement control device; and said displacement device including a first upward adjustable biasing means for upwardly biasing said coater die away from said base material feeding roller and a second downward adjustable biasing means for downwardly biasing said coater die toward said base material feeding roller, whereby said coater die is vertically displaceable against the action of said displacement control device in accordance with the pressure at which viscous material is discharged from said coater die.

9. A coating apparatus according to claim 8, wherein said first upward adjustable biasing means and said second downward adjustable biasing means comprise first and second spring means, respectively.

10. A coating apparatus according to claim 9, wherein said discharge pressure of viscous material from the coater die strives to expand said first spring means and to compress said second spring means.

11. A coating apparatus according to claim 8, wherein the displacement control device comprises an air cylinder having upper and lower chambers, said lower chamber providing a first upward adjustable biasing means and said upper chamber providing a second downward adjustable biasing means.

12. A coating apparatus according to claim 8, wherein said first downward adjustable biasing means includes a weight serving to bias the coater die towards the base material feeding roller and said second upward adjustable biasing means includes a counter weight serving to bias the coater die away from the base material feeding roller.

13. A coating apparatus according to claim 8, wherein a cooling medium flows through the interior of the base material feeding roller during the coating process.

14. A coating apparatus according to claim 13, wherein the base material feeding roller comprises a metallic roller.

* * * * *